US010176948B2

(12) United States Patent
Lee

(10) Patent No.: US 10,176,948 B2
(45) Date of Patent: Jan. 8, 2019

(54) MANUAL CHARGING APPARATUS FOR VACUUM INTERRUPTER

(71) Applicant: LSIS CO., LTD., Anyang-si, Gyeonggi-do (KR)

(72) Inventor: Jaewon Lee, Anyang-si (KR)

(73) Assignee: LSIS CO., LTD., Anyang-si, Gyeonggi-Do (KR)

( * ) Notice: Subject to any disclaimer, the term of this patent is extended or adjusted under 35 U.S.C. 154(b) by 0 days.

(21) Appl. No.: 15/390,370

(22) Filed: Dec. 23, 2016

(65) Prior Publication Data

US 2017/0186573 A1 Jun. 29, 2017

(30) Foreign Application Priority Data

Dec. 28, 2015 (KR) ..... 20-2015-0008552 U

(51) Int. Cl.
*H01H 33/666* (2006.01)
*H01H 33/42* (2006.01)
(Continued)

(52) U.S. Cl.
CPC ..... *H01H 33/666* (2013.01); *H01H 33/40* (2013.01); *H01H 33/42* (2013.01);
(Continued)

(58) Field of Classification Search
CPC ..... H01H 33/666; H01H 33/40; H01H 33/42; H01H 33/36; H01H 33/46; H01H 33/50;
(Continued)

(56) References Cited

U.S. PATENT DOCUMENTS 2,914,635 A * 11/1959 Lester ..... H01H 3/3042 200/50.21
3,868,860 A * 3/1975 Ishimi ..... F16H 29/12 74/63
(Continued)

FOREIGN PATENT DOCUMENTS

CN 201896885 U 7/2011
EP 0947722 A2 * 10/1999 ..... F16D 41/067
(Continued)

OTHER PUBLICATIONS

Korean Intellectual Property Office Application No. 20-2015-0008552, Office Action dated Nov. 30, 2016, 4 pages.
(Continued)

*Primary Examiner* — Edwin A. Leon
*Assistant Examiner* — William A Bolton
(74) *Attorney, Agent, or Firm* — K&L Gates LLP

(57) ABSTRACT

A manual charging apparatus for a vacuum interrupter, including a motor for charging a closing spring mounted on a vacuum interrupter; a charging shaft configured to rotate by a rotational force of the motor; and a manual charging handle coupled to one end of the charging shaft and configured to manually rotate the manual charging handle, wherein the manual charging handle includes an insertion part formed in an cylindrical shape and inserted into one end of the charging shaft; an extension part vertically bent from the insertion part and extended to increase a revolution torque; and a handle part vertically bent from the extension part and configured to apply a manual operation force, and wherein the insertion part includes a rotation restriction means configured to restrict a rotation in one direction.

4 Claims, 7 Drawing Sheets

(51) Int. Cl.
*H01H 33/40* (2006.01)
*H01H 33/36* (2006.01)
*F02N 1/02* (2006.01)

(52) U.S. Cl.
CPC ..... *F02N 1/02* (2013.01); *H01H 33/36* (2013.01); *H01H 2235/016* (2013.01)

(58) Field of Classification Search
CPC ..... H01H 71/10; H01H 71/43; H01H 71/70; H02B 11/133; H02B 11/167; H02B 1/00; F02N 1/02
USPC ..... 218/140, 120, 153, 154; 200/50.21, 180, 200/428; 173/178
See application file for complete search history.

(56) References Cited

U.S. PATENT DOCUMENTS

| | | | | |
|---|---|---|---|---|
| 5,638,929 | A * | 6/1997 | Park | F16D 15/00 192/44 |
| 8,481,880 | B2 * | 7/2013 | Bottcher | H01H 3/3047 200/400 |
| 8,662,271 | B2 * | 3/2014 | Iwano | F16D 41/105 192/44 |
| 8,763,722 | B2 * | 7/2014 | Braun | B25D 16/003 173/178 |
| 2008/0296137 | A1 * | 12/2008 | Chen | H01H 3/3005 200/400 |
| 2012/0125752 | A1 * | 5/2012 | Yamamoto | H01H 3/3031 200/469 |

FOREIGN PATENT DOCUMENTS

| | | |
|---|---|---|
| GB | 1562677 | 3/1980 |
| JP | 60110944 | 7/1985 |
| JP | 2008131818 | 6/2008 |
| JP | 2011135773 | 7/2011 |
| JP | 2013135575 | 7/2013 |
| KR | 20000020304 A | 4/2000 |
| KR | 100319405 | 12/2001 |
| KR | 20040089265 | 10/2004 |
| KR | 100479672 | 3/2005 |
| KR | 100616404 | 8/2006 |
| KR | 100616404 B1 | 8/2006 |
| KR | 20100125812 | 12/2010 |
| KR | 100319405 | 12/2011 |
| KR | 101191159 | 10/2012 |
| KR | 101279893 | 6/2013 |
| KR | 200473529 | 7/2014 |
| KR | 101498686 | 3/2015 |

OTHER PUBLICATIONS

Korean Intellectual Property Office Application No. 20-2015-0008552, Search Report dated Apr. 22, 2016, 3 pages.
Chinese Office Action for related Chinese Application No. 201611237051.1; action dated Apr. 23, 2018; (7 pages).
European Patent Office Application Serial No. 16197014.0, Search Report dated May 22, 2017, 7 pages.

* cited by examiner

MANUAL CHARGING APPARATUS FOR VACUUM INTERRUPTER

CROSS-REFERENCE TO RELATED APPLICATION

Pursuant to 35 U.S.C. § 119(a), this application claims the benefit of earlier filing date and right of priority to Korean Application No. 20-2015-0008552, filed on Dec. 28, 2015, the contents of which are all hereby incorporated by reference herein in its entirety.

BACKGROUND OF THE INVENTION

1. Field of the Invention

The present invention relates to a manual charging apparatus for a vacuum interrupter, more particularly, to a manual charging apparatus for a vacuum interrupter including a safety device to protect a worker when working for charging a spring of an open/close device using a manual charging handle.

2. Description of the Conventional Art

In general, a vacuum interrupter is a device used in an extra-high voltage/high voltage distribution lines, which protects life and load appliances by cutting off a circuit by a vacuum suppression method in a vacuum interrupter within a circuit breaker by a separate signal of an external electric relay when an abnormal current such as an over current, a ground fault, a short current, and the like is generated. Such a vacuum interrupter is disposed within a circuit breaker together with other electric appliances for operation or control of power plants or substations, or operation of motors.

The vacuum interrupter uses a spring for closing or trip operations. In this instance, a motor is used to charge the spring, and the spring is charged by use of the motor. The motor is driven electrically, while manually rotated when an electric power is not available.

FIG. 1 is a perspective view illustrating a front side of a vacuum interrupter according to a conventional art, and FIG. 2 is a perspective view illustrating a rear side of a vacuum interrupter according to a conventional art, in which FIG. 1 shows that a front panel of the vacuum interrupter is removed and FIG. 2 shows that a rear panel is removed.

When a motor 1 is driven, the rotational force of the motor 1 is transmitted to a charging shaft 3 via a chain 2 so that the charging shaft 3 is rotated. When the charging shaft 3 is rotated, a charging pawl 4 connected to the charging shaft 3 pushes a tooth of a charging gear 6 fixed to a main shaft 5 one by one, thereby rotating the charging gear 6.

When the charging gear 6 is rotated, a charging cam 7 fixed to the main shaft 5 is rotated in the clockwise direction based on the drawing. As the charging cam 7 is rotated, a charging lever 9 tenses a closing spring 10 while rotating at the center of the lever shaft 9*a*, and the charging pawl 4 prevents a counter-rotation of the charging gear 6.

When the main shaft 5 is rotated at a predetermined angle, the closing spring 10 is in a maximally elongated state to accumulate energy in a closing standby state, and in this instance an operation piece 11 of a limit switch is turned to operate the limit switch so that the motor 1 is turned off.

When a closing latch 12 is released by a closing signal of the vacuum interrupter, a closing roller pushes the charging lever 9 by an instantaneous elastic energy of the closing spring 10 to rotate the charging lever 9 at the center of a lever shaft 9*a*, as a result, a link mechanism (not shown) connected to the charging lever 9 is interworked therewith, thereby moving a closing lever up to a closing position so that a closing operation is completed. Concurrently, a trip spring 14 is charged and an opening standby state.

FIG. 3 shows a manual charging handle according to a conventional art.

In general, the motor 1 is operated by a control power to tense the closing spring 10, but in some instances the motor 1 may be manually rotated and in this case, a manual charging handle H is used for such purpose.

When the manual charging handle H is rotated after being inserted into the charging shaft 3, the closing spring 10 is charged. In this instance, a power is transmitted in a state that a protrusion formed on the manual handle H is inserted into a groove formed on the charging shaft 3.

However, in such a vacuum interrupter according to a conventional art has a disadvantage in that when a power is turned on suddenly or erroneously during a manual charging work, the charging shaft 3 is rotated at a high speed by the motor 1 and the rotational force is transmitted to a worker, thereby causing injury to the worker.

Such a conventional art may be referred to as Korean Patent No. 10-0319405 and Korean Patent No. 10-0479672.

SUMMARY OF THE INVENTION

An object of the present invention is to provide a manual charging apparatus for a vacuum interrupter including a safety device to protect a worker when working for charging a spring of an open/close device using a manual charging handle.

To achieve these and other advantages and in accordance with the purpose of this specification, as embodied and broadly described herein, there is provided a manual charging apparatus for a vacuum interrupter, including a motor for charging a closing spring mounted on a vacuum interrupter; a charging shaft configured to rotate by a rotational force of the motor; and a manual charging handle coupled to one end of the charging shaft and configured to manually rotate the manual charging handle, wherein the manual charging handle includes an insertion part formed in an cylindrical shape and inserted into one end of the charging shaft; an extension part vertically bent from the insertion part and extended to increase a revolution torque; and a handle part vertically bent from the extension part and configured to apply a manual operation force, and wherein the insertion part includes a rotation direction restriction means configured to restrict a rotation in one direction.

In one embodiment, the rotation restriction means includes an outer wheel formed in a cylindrical shape and having a plurality of wedge-shaped grooves on its inner circumferential surface; an inner wheel disposed within and spaced apart from the outer wheel and having a plurality of through holes; and a plurality of roller elements disposed between the outer wheel and the inner wheel.

In one embodiment, the wedge-shaped grooves are formed in an asymmetrical 'U'-shape.

In one embodiment, an outer radius of the outer wheel is larger than or the same as an inner radius of the insertion part.

In one embodiment, the rotation restriction means includes a one way clutch bearing.

In one embodiment, the charging shaft includes a gear part and a shaft part and the shaft part is formed linearly.

In one embodiment, a power transmission means is provided between the motor and the charging shaft, and the power transmission means includes a motor gear coupled to the motor and a chain configured to connect the motor gear and the charging shaft.

The manual charging apparatus for a vacuum interrupter according to one embodiment of the present invention provides an advantage in that a worker is protected from a possible accident during a charging work by causing a manual charging handle not to rotate by a rotation direction restriction means even though a control power is supplied to a motor while performing a manual charging work for a closing spring using a manual charging handle.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings:

FIGS. 8 and 9 are sectional views illustrating operations of the manual charging apparatus of a vacuum interrupter, in which FIG. 8 shows that the manual charging handle is rotated preemptively and FIG. 9 shows that the charging shaft is rotated preemptively, in accordance with one embodiment of the present invention.

DETAILED DESCRIPTION OF THE PREFERRED EMBODIMENT

Figure 1:
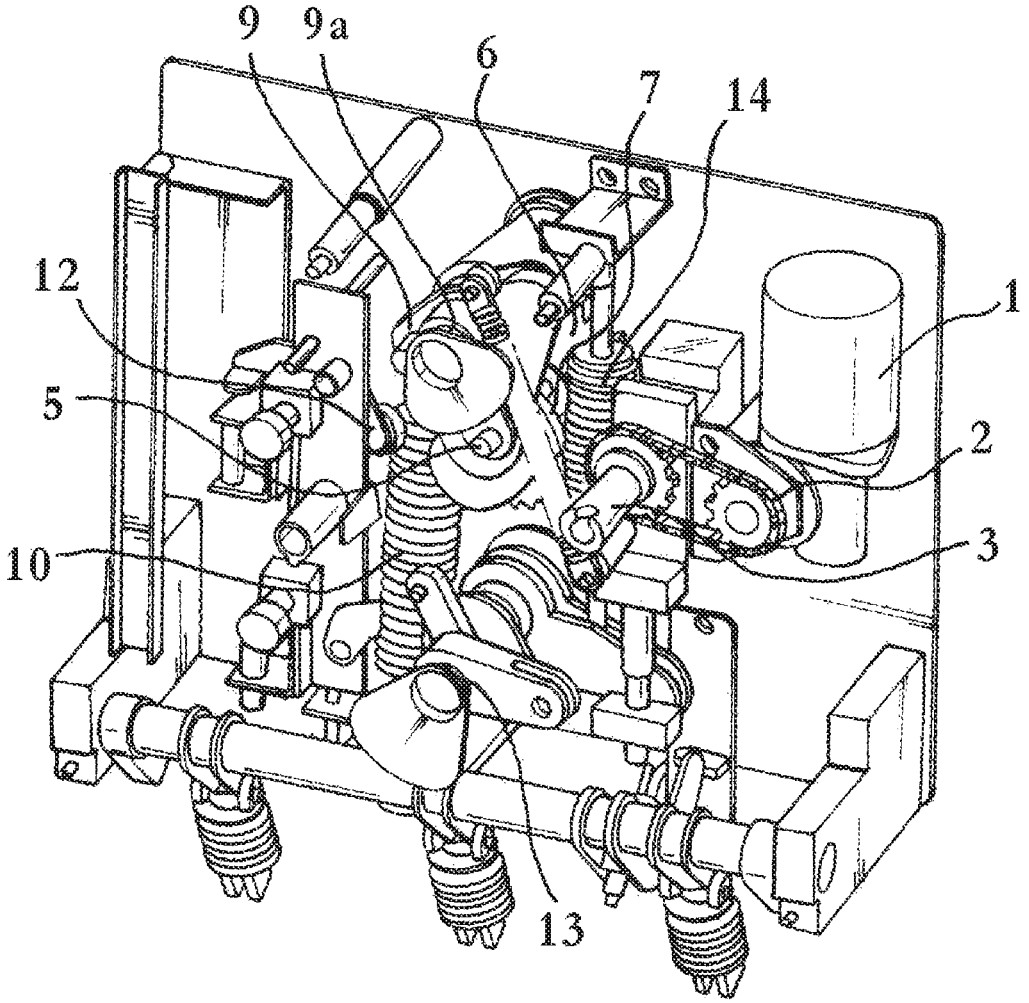
Fig. 1 Prior Art
FIG. 1 is a perspective view illustrating an open/close device of a vacuum interrupter according to a conventional art.
Figure 2:
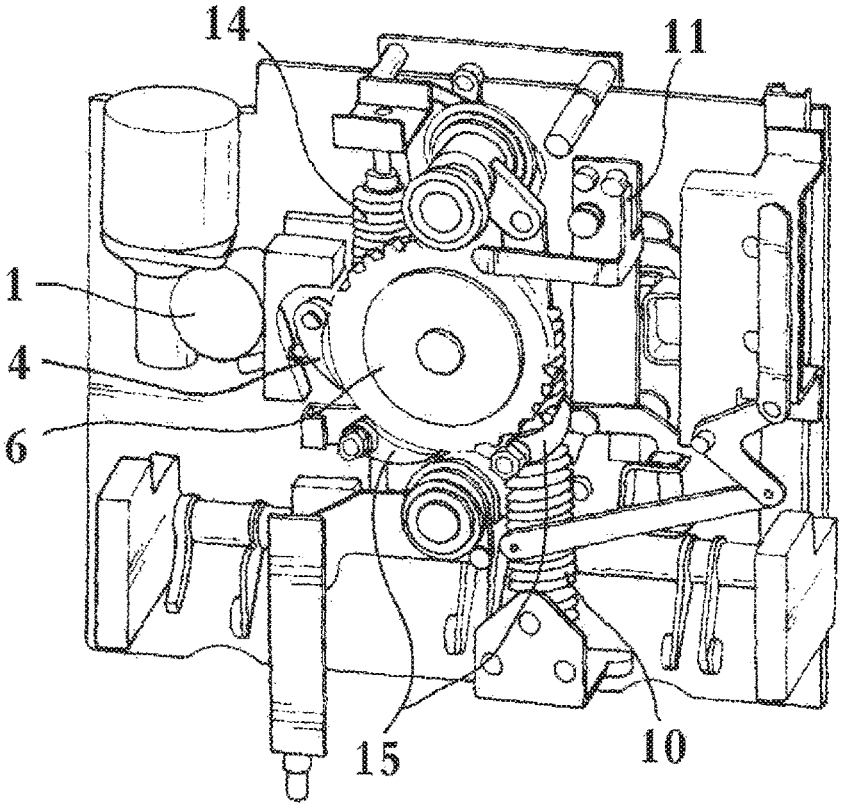
Fig. 2 Prior Art
FIG. 2 is a rear perspective view of FIG. 1.
Figure 3:
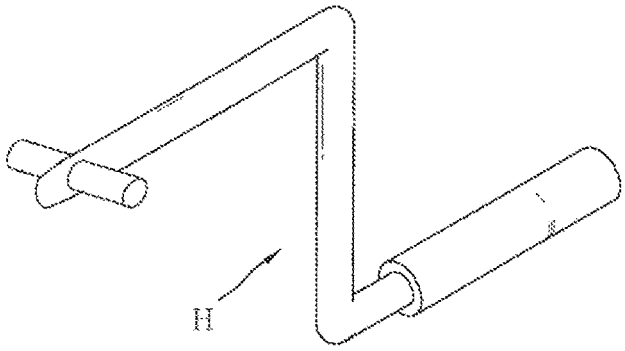
Fig. 3 Prior Art
FIG. 3 is perspective a view illustrating a manual charging handle according to a conventional art.
Figure 4:
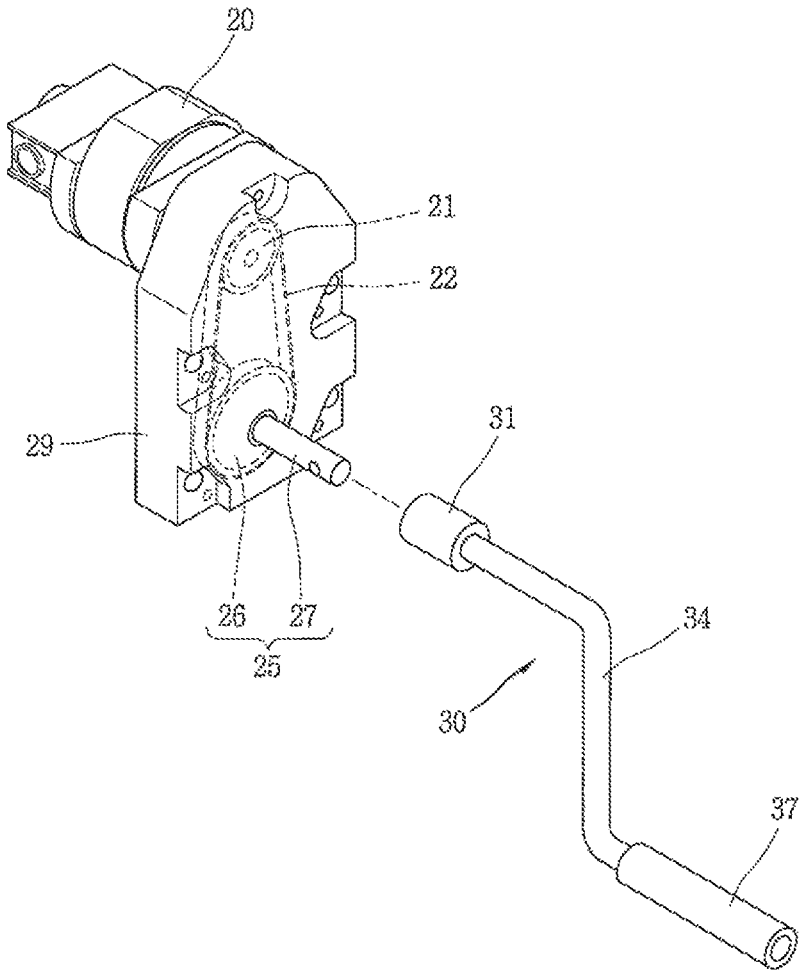
FIG. 4 is a perspective view illustrating a manual charging apparatus, in accordance with one embodiment of the present invention.
Figure 5:
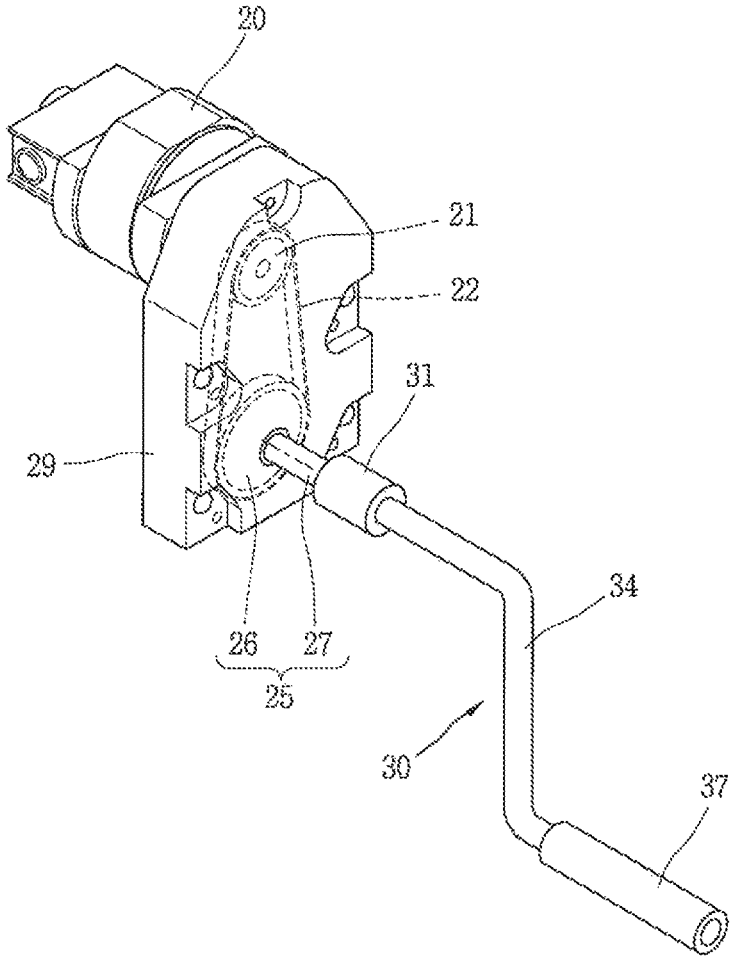
FIG. 5 is a perspective view of FIG. 4 in an assembled state.
Figure 6:
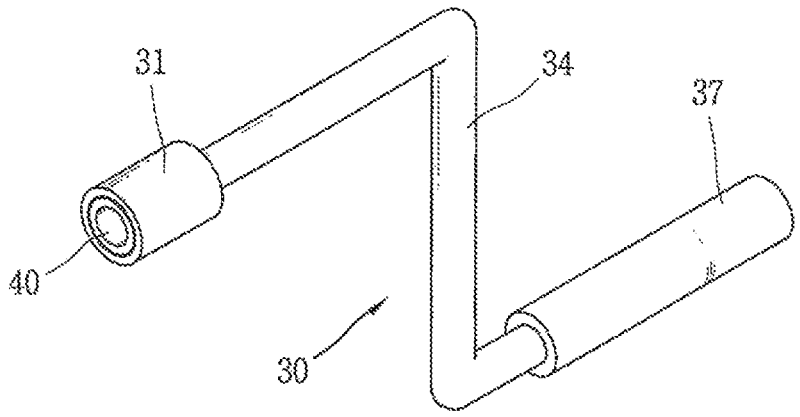
FIG. 6 is a perspective view illustrating a manual charging handle, in accordance with one embodiment of the present invention.
Figure 7A:
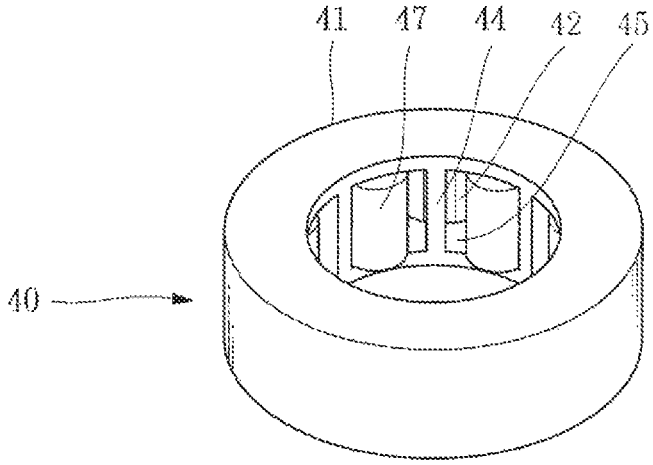
FIGS. 7A through 7C are a perspective view, a plane view and a longitudinal sectional view, respectively, illustrating a rotation direction restriction means which is applied to the manual charging apparatus of a vacuum interrupter, in accordance with one embodiment of the present invention.
Figure 7B:
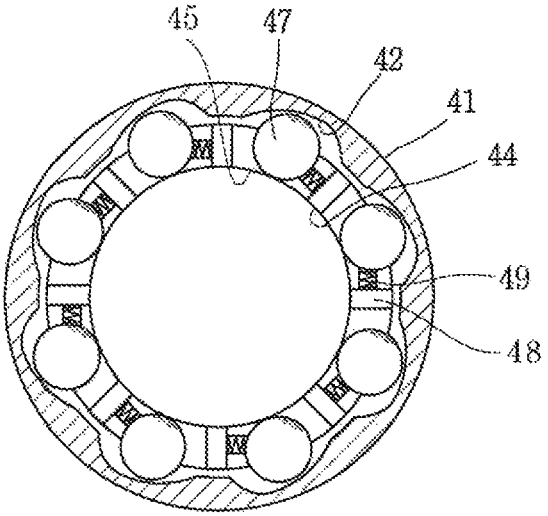
Figure 7C:
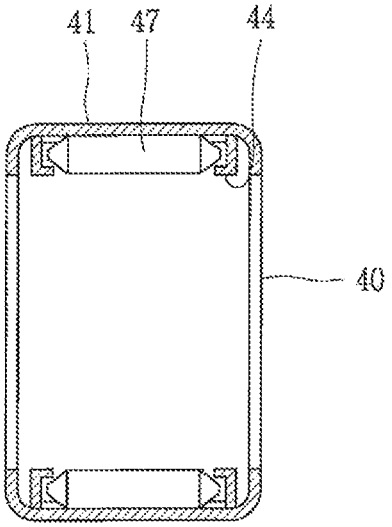

Hereinafter, a preferred embodiment of a manual charging apparatus of a vacuum interrupter in accordance with an embodiment of the present invention will now be described in detail with reference to the accompanying drawings.

Referring to FIGS. 4 through 7C, the manual charging apparatus of a vacuum interrupter in accordance with an embodiment of the present invention includes a motor 20 disposed on a vacuum interrupter main body (not shown) and configured to supply a power for charging a closing spring (not shown), a charging shaft 25 configured to rotate by a rotational force of the motor 20, and a manual charging handle 30 coupled to one end of the charging shaft 25 and configured to manually rotate the charging shaft 25. The manual charging handle 30 includes an insertion part 31 formed in a cylindrical shape and inserted into one end of the charging shaft 25, an extension part 34 extendedly formed by vertically bending the insertion part 31 and configured to increase a revolution torque, and a handle part 37 formed by vertically bending the extension part 34 and configured to apply a manual manipulation force. The insertion part 31 includes a rotation direction restriction means 40 configured to restrict a charging shaft to rotate in one direction, The vacuum interrupter main body is the same as that of the conventional art, thus not shown for clarity purpose.

The motor 20 is disposed on the main boy for charging a closing spring. The motor 20 is connected to a control power source so as to be turned on or off.

A rotational force of the motor 20 is transmitted to the charging shaft 25 so that the charging shaft 25 may be rotated. The charging shaft 25 includes a gear part 26 and a shaft part 27.

Between the motor 20 and the charging shaft 25, a power transmission means, for instance, a motor gear 21 and a chain 22, may be disposed.

The motor gear 21 is axially connected with the motor 20 so as to be rotated at the same gear ratio with the motor 20.

The chain 22 is provided to transmit a rotational force of the motor 20 to the charging shaft 25. The chain 22 is configured to connect the motor gear 21 and the gear part 26. In this instance, the revolution ratio may be determined by the size of the motor gear 21 and gear part 26.

When a control power is applied to the motor 20, the motor 20 is rotated and the rotation force of the motor 20 is transmitted to the gear part 26 via the motor gear 21 and the chain 22, thereby rotating the shaft part 27 of the charging shaft 25.

The shaft part 27 may be formed linearly. That is, the shaft part 27 may be formed to have a smooth outer surface without a separate coupling means.

A casing 29 may be provided to accommodate therein the motor 20, the chain 22 and the charging shaft 25. The casing 29 may be formed of a metal or synthetic resin material so as to cover the motor 20, the motor gear 21, the chain 22 and the charging shaft 25.

The manipulation handle 30 is provided to manually rotate the charging shaft 25. The manual charging handle 30 mainly includes an insertion part 31, an extension part 34 and a handle part 37.

The insertion part 31 is formed in a cylindrical shape and may be inserted into one end of the charging shaft 25. The insertion part 31 may be provided with a rotation direction restriction means 40 which is configured to restrict a rotation to one direction.

The extension part 34 may be formed in a rod of '¬' shape. The extension part 34 is extended and vertically bent from the insertion part 31 and configured to increase a revolution torque.

The handle part 37 is vertically bent from the extension part 34 and configured to apply a manual manipulation force. The handle part 37 may have a concavo-convex portion on its surface to enable easy grip, though not shown.

When rotating the handle part 37 with the insertion part 31 inserted into the shaft part 27 of the charging shaft 25, the shaft 27 is rotated while increasing torque by the extension part 34.

The rotation direction restriction means 40 is provided within the insertion part 31 to perform a transmission of power between the manual charging handle 30 and the charging shaft 25 in one direction.

The rotation direction restriction means 40 is configured to transmit a rotation force to the charging shaft 25 in case of rotating the manual charging handle 30, while in a case where the charging shaft 25 is rotated, to cutoff the rotational force to the manual charging handle 30.

The rotation direction restriction means 40 may include an outer wheel 41, an inner wheel 44, and a plurality of roller members 47 provided between the outer wheel 41 and the inner wheel 44.

The outer wheel 41 includes a ring having an asymmetrical 'U' shaped wedge-shaped groove 42 on its inner circumferential surface. An outer radius of the outer wheel 41 may be the same as or larger than an inner radius of the insertion part 31 so as to be tight-fitted. Thus, the outer wheel 41 may be rotated together with the insertion part 31.

A plurality of wedge-shaped grooves 42 may be provided on an inner surface of the outer wheel 41. The wedge-shaped grooves 42 are formed to have one side narrow (shallow) and another side wide (deep). The wedge-shaped grooves 42 may be formed in an asymmetrical 'U' shaped groove. Thus, the roller members 47 can not rotate at the narrow (shallow) portion of the groove 42 due to an insertion, but can be freely rotated at the other side, that is, wide (deep) portion of the groove 42.

The inner wheel 44 may be disposed within the outer wheel 41 and formed to have a radius smaller than that of the outer wheel 41, and includes a plurality of through holes 45. The inner wheel 44 is configured to support and fix the roller members 47.

The roller members 47 are disposed between the outer wheel 41 and the inner wheel 44. More particularly, the roller members 47 are disposed between the wedge-shaped groove 42 of the outer wheel 41 and the inner wheel 44. The roller member 47 may be partially exposed through the through holes 45 of the inner wheel 44.

When the outer wheel 41 is rotated in the clockwise direction so that the roller member 47 is located at a narrow portion of the wedge-shaped grove 42, the roller member 47 is inserted between the outer wheel 41 and an internal shaft (for instance, the shaft part 27), thus causing a frictional force therebetween and the rotational force of the outer wheel 41 is directly transmitted to the internal shaft of the inner wheel 44. That is, when the outer wheel 41 is rotated in the clockwise direction, the rotational force of the outer wheel 41 is directly transmitted to the internal shaft of the inner wheel 44. That is, when rotating the manual charging handle 30 in the clockwise direction, the charging shaft 25 is rotated by the rotational force of the manual charging handle 30 via the rotation direction restriction means 40.

When the internal shaft (for instance, the shaft) of the inner wheel 44 is rotated in the clockwise direction so that the roller member 47 is located at the wide portion of the wedge-shaped groove 42, the roller member 47 can be freely rotated between the outer wheel 41 and the inner wheel 44, thereby the rotational force of the internal shaft of the inner wheel 44 is not transmitted to the outer wheel 41. That is, in a case where the internal shaft of the inner shaft 44 is rotated in the clockwise direction, the roller member 47 is rotated without load, that is, is idled, thereby the rotation force of the internal shaft of the inner wheel 44 is not transmitted to the outer wheel 41. That is to say, even in a case where the charging shaft 25 is rotated by driving the motor 20 while at working using the manual charging handle 30, the rotational force is not transmitted to the outer wheel 41 so that the manual charging handle 30 is maintained stopped, but rotates the roller member 47.

An elastic member 49 may be disposed to apply an elastic force to the roller member 47, which is configured to move the roller member 49 to a narrow portion of the wedge-shaped groove 42. The elastic member 47 may be disposed between an isolation wall formed between the outer wheel 41 and the inner wheel 44 and the roller member 47. Here, the elastic member 49 is disposed at the side portion of the wedge-shaped groove 42.

Figure 8:
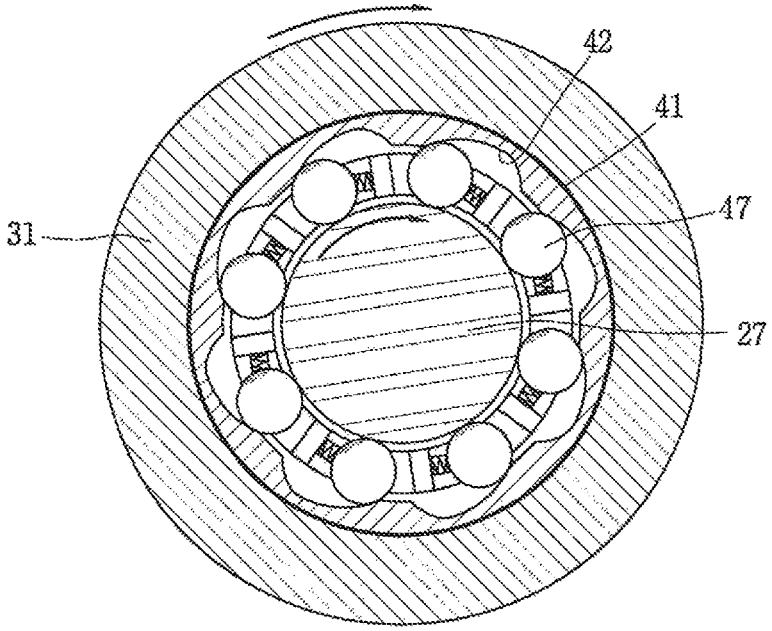
Figure 9:
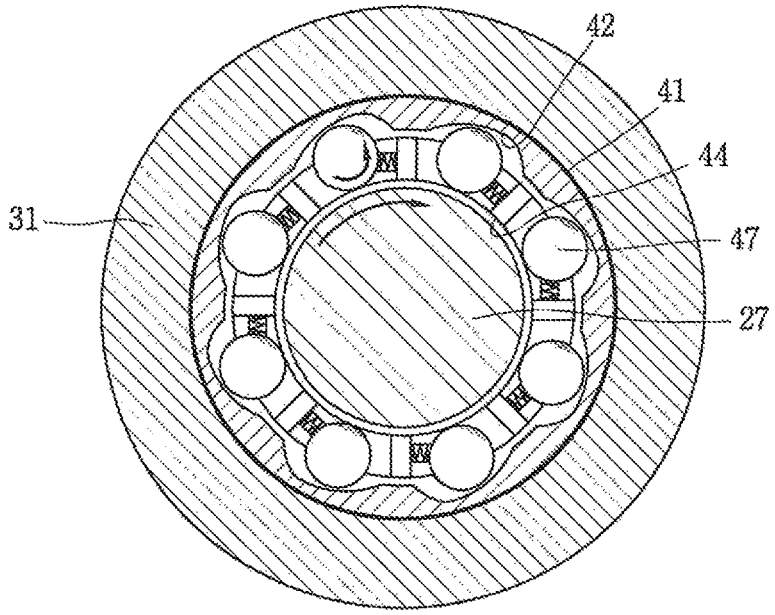

Referring to FIGS. 8 and 9, the operation of the manual charging apparatus of a vacuum interrupter in accordance with one embodiment of the present invention will be described. FIGS. 8 and 9 are cross sectional views illustrating the insertion part 31 in a state that the manual charging handle 30 is inserted into the shaft part 27 of the charging shaft 25, in which FIG. 8 shows that the manual charging handle 30 is rotated preemptively, and FIG. 9 shows that the charging shaft 25 is rotated preemptively.

Referring first to FIG. 8, when the manual charging handle 30 is rotated in clockwise direction, the rotational force is transmitted to the charging shaft 25 via the rotation direction restriction means 40. Specifically, when the outer wheel 41, which is tight-fitted to the manual charging wheel 30, is rotated in the clockwise direction and the roller member 47 is located at the narrow portion of the wedge-shaped groove 42, the roller member 47 is located between the outer wheel 41 and the shaft part 27 so that a frictional force is generated therebetween, thereby the rotational force of the outer wheel 41 is directly transmitted to the shaft part 27. That is, when the manual charging handle 30 is rotated in the clockwise direction, the rotational force of the manual charging handle 30 is transmitted to the shaft part 27 as it is.

Next, referring to FIG. 9, even in a case where the charging shaft 25 is rotated by rotation of the motor 20 at working using the manual charging handle 30, the rotational force is not transmitted to the outer wheel 41, but is transmitted to the roller member 47, thus the manual charging handle 30 remains stopped.

More specifically, when the shaft part 27 is rotated in the clockwise direction so that the roller member 47 is located at the wide portion of the wedge-shaped groove 42, the roller member 47 can freely rotate between the outer wheel 41 and the inner wheel 44 so that the rotational force of the shaft part 27 is not transmitted to the outer wheel 41. That is, when the charging shaft 25 is rotated in the clockwise direction, the roller member 47 is in an idle state, thereby the rotational force of the charging shaft 25 is not transmitted to the manual charging handle 30.

In accordance with one embodiment of the present invention, there is provided an effect in that it is possible to protect a worker from safety accident by preventing a rotational force of the charging shaft from being transmitted to the manual charging handle by a rotational direction restriction means, even in a case where a control power is supplied to the motor when performing a manual charging to a closing spring using a manual charging handle.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A manual charging apparatus for a vacuum interrupter, the apparatus comprising:

a motor configured to charge a closing spring mounted on a vacuum interrupter main body;

a charging shaft configured to rotate according to a rotational force of the motor; and a manual charging handle coupled to one end of the charging shaft and configured to manually rotate the charging shaft, wherein the manual charging handle includes a cylindrical insertion part coupled to one end of the charging shaft, a vertically bent extension part extending from the cylindrical insertion part and configured to increase a revolution torque, and a vertically bent handle part extending from the vertically bent extension part and configured to apply a manual operation force, wherein the cylindrical insertion part includes a rotation direction restriction means configured to restrict rotation of the cylindrical insertion part in one direction, and wherein the rotation direction restriction means includes a cylindrical outer wheel having a plurality of wedge-shaped grooves formed in an asymmetrical 'U'-shape on an inner circumferential surface, an inner wheel disposed within and spaced apart from the outer wheel and having a plurality of through holes, a plurality of roller elements disposed between the outer wheel and the inner wheel, wherein the inner wheel supports the plurality of roller elements, and wherein the plurality of roller elements are partially exposed through the through holes of the inner wheel, and an elastic member configured to apply an elastic force to the plurality of roller elements such that the plurality of roller elements move to a narrow portion of the plurality of wedge-shaped grooves, wherein the elastic member is supported by an isolation wall formed between the outer wheel and the inner wheel to push the plurality of roller elements along a circumferential direction.

2. The manual charging apparatus of claim 1, wherein an outer radius of the outer wheel is larger than or the same as an inner radius of the cylindrical insertion part.

3. The manual charging apparatus of claim 1, wherein the charging shaft includes a gear part and a linearly formed shaft part.

4. The manual charging apparatus of claim 1, further comprising a power transmission means between the motor and the charging shaft, the power transmission means including a motor gear coupled to the motor and a chain configured to connect the motor gear to the charging shaft.

* * * * *